US007786948B2

(12) United States Patent
Webb et al.

(10) Patent No.: US 7,786,948 B2
(45) Date of Patent: Aug. 31, 2010

(54) ARRAY ANTENNA WITH EMBEDDED SUBAPERTURES

(75) Inventors: Kenneth M. Webb, North Hills, CA (US); Timothy D. Keesey, Garden Grove, CA (US)

(73) Assignee: Raytheon Company, Waltham, MA (US)

( * ) Notice: Subject to any disclaimer, the term of this patent is extended or adjusted under 35 U.S.C. 154(b) by 178 days.

(21) Appl. No.: 11/897,662

(22) Filed: Aug. 31, 2007

(65) Prior Publication Data

US 2009/0058754 A1 Mar. 5, 2009

(51) Int. Cl.
*H01Q 21/00* (2006.01)

(52) U.S. Cl. ..... 343/853; 343/850; 342/383

(58) Field of Classification Search ..... 343/853, 343/850; 342/383, 368
See application file for complete search history.

(56) References Cited

U.S. PATENT DOCUMENTS 5,343,211 A * 8/1994 Kott ..... 342/379
5,532,706 A * 7/1996 Reinhardt et al. ..... 343/778
5,864,317 A 1/1999 Boe et al.
6,356,233 B1 * 3/2002 Miller et al. ..... 342/368
6,421,021 B1 7/2002 Rupp et al.
6,954,173 B2 10/2005 Mrstik
7,081,851 B1 7/2006 Lewis
7,450,066 B2 * 11/2008 Haskell ..... 342/368
2007/0152772 A1 * 7/2007 Runyon ..... 333/117

* cited by examiner

*Primary Examiner*—HoangAnh T Le
(74) *Attorney, Agent, or Firm*—Christie, Parker & Hale LLP

(57) ABSTRACT

An array antenna with an embedded subaperture includes an array of radiator elements. The array includes a subaperture of one or a group of the radiator elements. A main receive channel is coupled to at least some of the radiator elements by a feed network. An RF power dividing network is connected in a signal path between the subaperture and the special use receive channel, and is adapted to allow at least most of the RF energy from the subaperture to pass to the special use receiver channel while diverting a small amount of energy to the main receive channel. The array includes circuitry for introducing an amplitude taper to signals received from the array of radiator elements, so that some of the signals from the radiator elements are attenuated to achieve the amplitude taper. The circuitry in an exemplary embodiment includes the RF power dividing network, wherein the small amount of energy diverted to the main receive channel from the subaperture is substantially equal to an attenuated signal level for the subaperture to achieve an amplitude taper attenuation.

21 Claims, 3 Drawing Sheets

ARRAY ANTENNA WITH EMBEDDED SUBAPERTURES

BACKGROUND

Array antennas may have subapertures, i.e. small groups of elements, embedded in the main aperture which have some of their received energy sent to a separate (from the main) receiver channel for a special use such as a guard channel. In many cases, an RF coupler in the feed network diverts a small amount of the subaperture receive energy to the special use channel without significantly affecting the main channel. The subaperture may have too little receive gain and too high a noise figure for some purposes.

SUMMARY OF THE DISCLOSURE

An array antenna with an embedded subaperture includes an array of radiator elements. The array includes a subaperture of one or a group of the radiator elements. A main receive channel is coupled to at least some of the radiator elements by a feed network. An RF power dividing network is connected in a signal path between the subaperture and the special use receive channel, and is adapted to allow at least most of the RF energy from the subaperture to pass to the special use receiver channel while diverting a small amount of energy to the main receive channel. The array includes circuitry for introducing an amplitude taper to signals received from the array of radiator elements, so that some of the signals from the radiator elements are attenuated to achieve the amplitude taper. The circuitry includes the RF power dividing network, wherein the small amount of energy diverted to the main receive channel from the subaperture is substantially equal to an attenuated signal level for the subaperture to achieve an amplitude taper attenuation.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
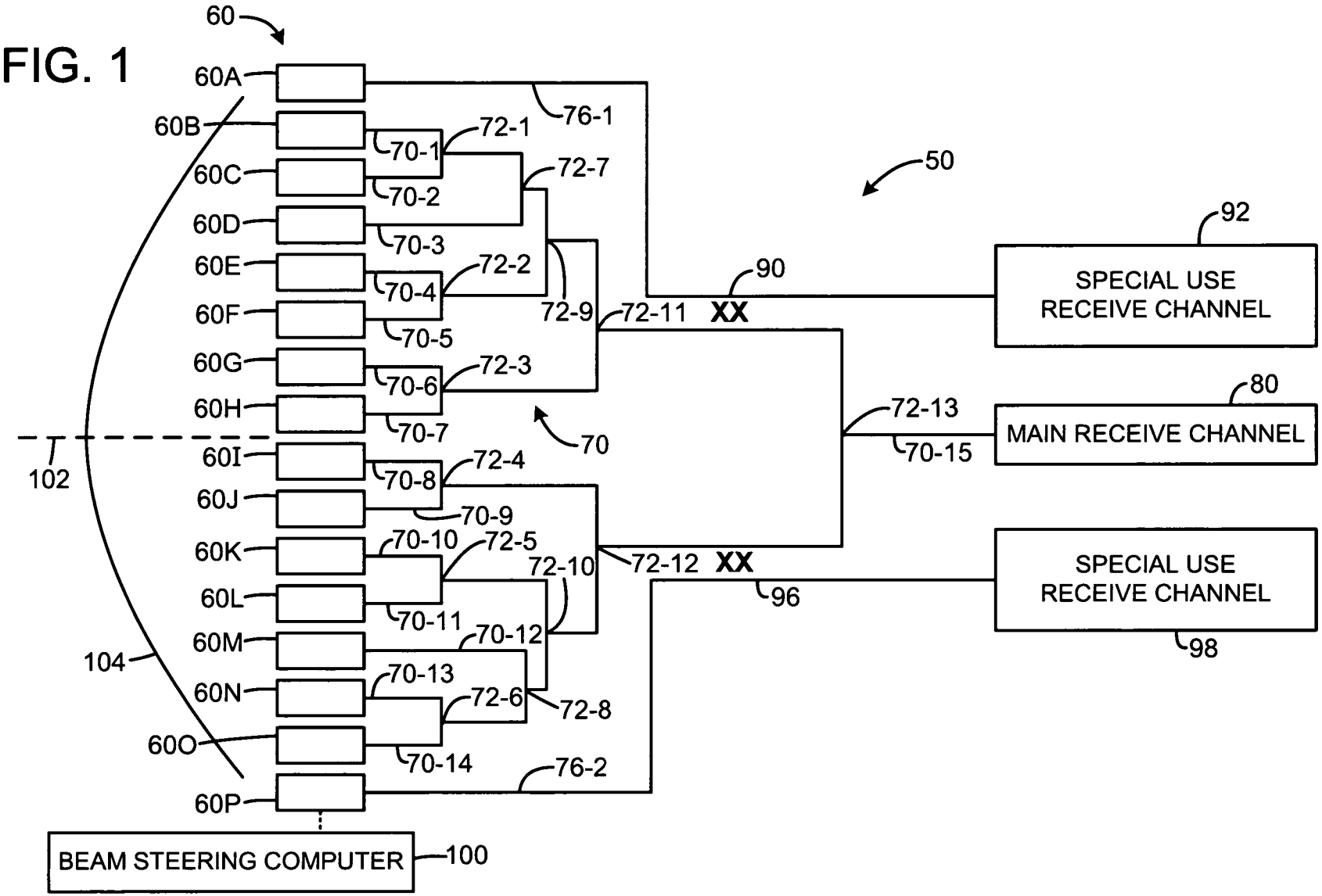
FIG. 1 is a simplified schematic diagram of an exemplary embodiment of an active array antenna system with special use receive channels.

In the following detailed description and in the several figures of the drawing, like elements are identified with like reference numerals. The figures are not to scale, and relative feature sizes may be exaggerated for illustrative purposes.

An exemplary embodiment of an antenna architecture optimizes system performance by embedding a subaperture in a way that allows the subaperture to remain a part of the active area of the main antenna, while still acting as an independent aperture. The result is that the main aperture retains all of its active area and the subaperture sends most of its RF energy to the special use receiver channel without significant reduction in its independence.

An exemplary embodiment of this architecture capitalizes on the fact that most active arrays utilize some form of attenuation on the elements in receive to achieve an amplitude taper across the array. Whether achieved by T/R element commands to set variable attenuators in the T/R element, or in the receive RF feed, this attenuation may be relocated to a strategic location in the feed. At an appropriate level in the RF feed, the energy from the selected element or group of elements can pass through an RF power dividing network or device which diverts a small amount of energy equal to the expected attenuated signal level. A power dividing device suitable for the purpose is a directional RF coupler. The RF power dividing network or device allows most of the RF energy to pass to the special use receiver channel.

FIG. 1 schematically illustrates aspects of an exemplary embodiment of an active array antenna system 50, which includes an array 60 of radiator elements 60A, 60B . . . 60P. The radiator elements may typically include a radiator, a variable or fixed attenuator, and a variable or fixed phase shifter. Generally, the variable or controllable elements of the radiator elements may be controlled by a beam steering computer 100. In this example, each of the radiator elements 60A-60P may be included in the main aperture which are fed to the main receive channel 80, and the edge elements 60A and 60P may further contribute to subapertures which are fed to special use receive channels 92 and 98. One exemplary special use channel is a "guard channel" as described, e.g., in "*Introduction to Airborne Radar.*" Stimpson, at page 366.

The radiator elements 60B, 60C . . . 60O are connected to a main feed network 70, which has a plurality of ports 70-1, 70-2 . . . 70-14 connected to the output (or I/O in the case of an active array) ports of each of these radiator elements. The network 70 combines the contributions from these radiator elements at a single port 70-15. In an exemplary embodiment, the feed network 70 may be constructed, e.g., as a corporate feed network. The feed network 70 includes a plurality of combiners 72-1, 72-2 . . . 72-13 which combine the signal contributions from radiator elements 60B-600 at port 70-15.

In an exemplary embodiment, the array may have an amplitude taper, indicated generally as 102, applied to the signal contributions from the radiators of the respective radiating elements to the main receive channel. In the example depicted in FIG. 1, the amplitude taper results in maximum amplitude applied to the radiator elements in the center of the array, e.g. radiator elements 60H, 60I, and progressively smaller amplitudes applied to radiator elements away from the center of the array, with the edge radiator elements 60A, 60P providing the smallest amplitude contributions to the main receive channel. The amplitude taper may be provided by attenuation applied to the signal contributions from the signals received at the radiator elements away from the array center. The amplitude taper may be applied to reduce sidelobe levels of beams of the array or otherwise tune the array beam pattern. Conventionally, the amplitude taper has been applied in an exemplary embodiment dynamically by appropriate settings of variable attenuators included in the respective radiator elements under control of the beam steering computer 100, or by design of the feed network 70 to include appropriate power split ratios and attenuation to achieve the desired amplitude taper.

In this exemplary embodiment, the edge radiator elements 60A and 60P have output ports connected through lines 76-1 and 76-2 to ports of RF directional couplers 90 and 96, respectively. The directional couplers respectively divert a small amount of energy equal to the expected attenuated signal level for the respective edge radiator elements for the selected or desired array amplitude taper for the main receive channel. Thus, the power split ratios of the RF couplers 90 and 96 are set to match the main aperture amplitude taper for elements 60A and 60P, respectively. The RF directional couplers 96, 90 allow most of the RF energy to pass to the special use receiver channels 98 and 92, respectively. The RF directional coupler in an exemplary embodiment prevents energy from coupler 72-11 from being diverted to the special use receive channel 98, for example; the isolation from a directional coupler should be enough to prevent degraded performance. Say, for example, that the main amplitude taper for the main receive channel would apply an attenuation level of 12 dB to the signals received at the edge radiator elements 60A and 60P relative to the signal level received at the center of the array. Conventionally, the attenuation of 12 dB would be applied by setting attenuators in the radiator element or by design of the feed network. In the embodiment of FIG. 1, however, the power split ratio of RF couplers 90 and 96 is designed to divert to the main receive channel signals from the respective edge radiator elements 60A and 60P which are attenuated by 12 dB.

FIG. 1 illustrates generally receive channels, and omits transmit-specific features such as an exciter. It will be appreciated that the system may include a transmit channel as well as receive channels. However, it will be appreciated that the system may be a passive array.

Figure 2:
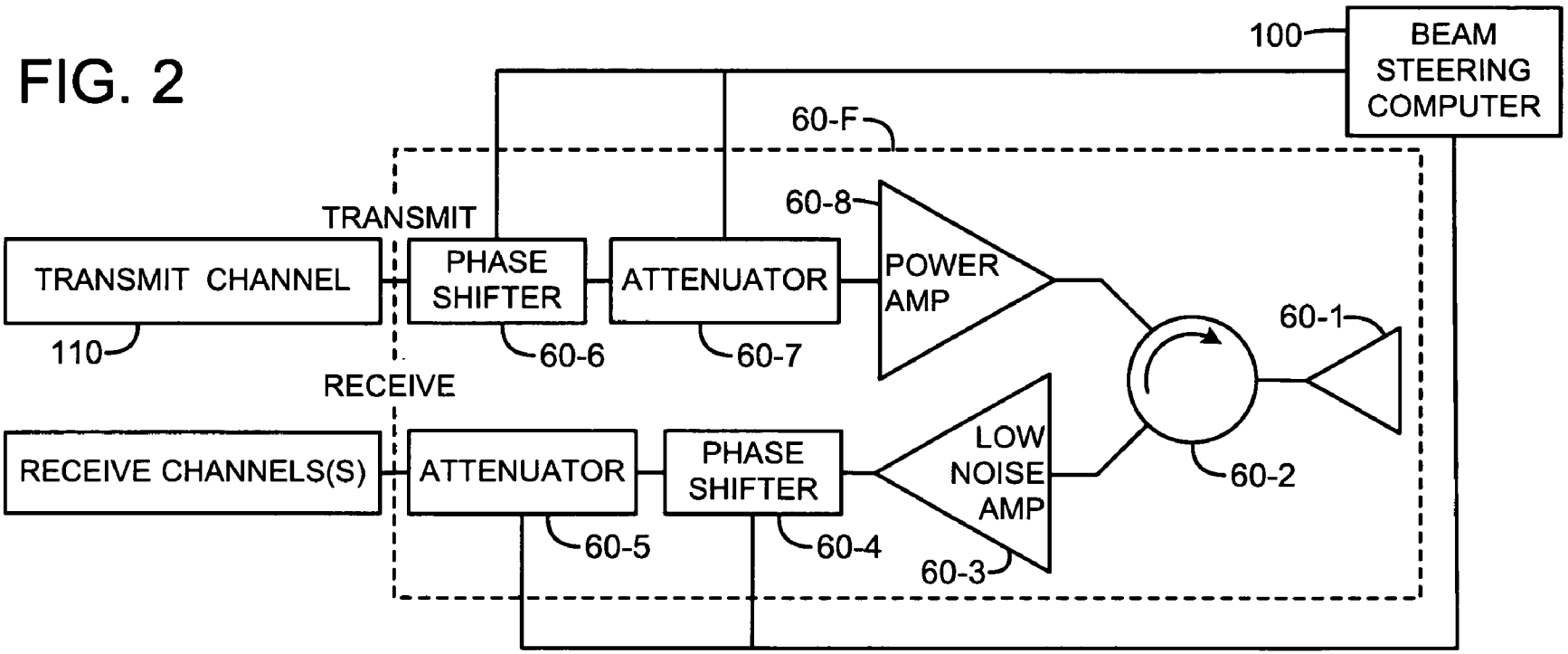
FIG. 2 is a schematic block diagram of an exemplary embodiment of a radiator element.

FIG. 2 schematically illustrates an exemplary architecture of an exemplary one (60-F) of the radiator elements comprising array 60. The radiator element may include radiator 60-1, a circulator 60-2, and receive and transmit channels. The receive channel includes a low noise amplifier 60-3, a phase shifter 60-4 and an attenuator 60-5, and may be connected to the receive channel(s). The transmit channel may be connected to a transmit channel 110, and include phase shifter 60-6, attenuator 60-7 and power amplifier 60-8. The attenuators 60-5 and 60-7 and the phase shifters 60-4 and 60-6 may be variable circuit components, whose respective attenuator and phase shift settings may be controlled by beam steering computer 100. The architecture depicted in FIG. 2 is merely one example, and other radiator element circuits may be employed, depending on the array application.

Figure 3:
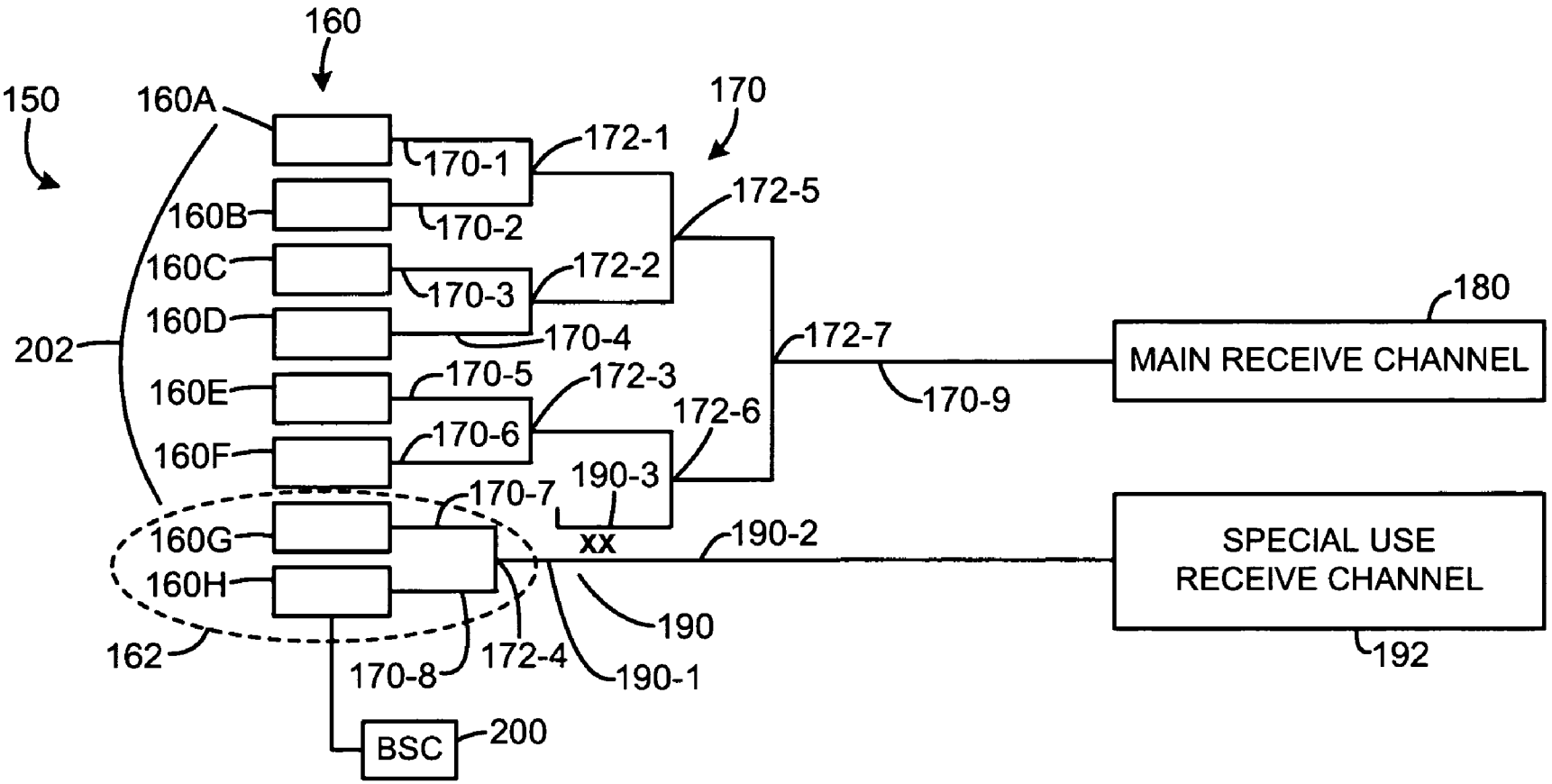
FIG. 3 is a simplified schematic diagram of another exemplary embodiment of an active array antenna system with special use receive channels.

An alternate embodiment of an array system 150 is depicted in FIG. 3, in which received signal contributions from a group 162 of radiator elements are sent to a special use receive channel 192, while also contributing to a main receive channel 180. In this exemplary embodiment, the system 150 includes radiator element array 160 including radiator elements 160A, 160B . . . 160H, and a feed network 170 connected between the radiator element array 160 and the main receive channel 180. The feed network 170, which has a plurality of ports 170-1, 170-2 . . . 170-8 connected to the output (or I/O in the case of an active array) ports of each of the radiator elements 160A-160H, combines the contributions from these radiator elements at a single port 170-9. In an exemplary embodiment, the feed network 170 may be constructed, e.g., as a corporate feed network. The feed network 170 includes a plurality of combiners 172-1, 172-2 . . . 172-7.

The array system 150 further includes a special use receive channel 192, which receives signal contributions from a subaperture including radiator elements 160G, 160H, through an RF coupler 190 which has an input 190-1 connected to the output of signal combiner 172-4, an output 190-2 connected to the special use receive channel 190, and another output 190-3 connected to the signal combiner 172-6 of the feed network 170. The coupling ratio between the two outputs is selected to provide the attenuation for elements 160G and 160H to achieve a desired main aperture amplitude taper 202. For radiator elements 160A-160F, any attenuation needed to achieve the desired amplitude taper may be provided by dynamic settings of attenuators in the radiator elements, by built-in feed taper, or both. In this exemplary embodiment, no dynamic or feed taper is applied to the signal contributions from the radiator elements 160G, 160H, and the attenuation is instead applied by the RF coupler 190. Hence the amplitude taper will not exactly match the ideal amplitude taper, but this is typically acceptable in an exemplary application. There are several reasons why this may be acceptable for some applications. First, the embedded apertures typically may be closer to an edge of the array because the center of the aperture generally requires full power to the main receive channel. Second, amplitude tapers (whether in the feed or achieved by T/R element attenuation) generally have a gradual slope with steps between elements being small, especially near the edges of the main aperture where the embedded apertures would be typically be placed. Third, errors at the edges of the array have significantly less impact on the performance of the system. So at the edges of the array, where the average attenuation might be around 16 dB or more, an error of 1 or 2 dB (representing 160H having the same attenuation as 160G, instead of having perhaps 1 or 2 dB more attenuation) would not have a noticeable affect.

The independent steering capability of the embedded subapertures may be limited only by the acceptable perturbation of the main channel performance. This may be explained through the analogy of a pair of bi-focal glasses. For an ESA with an embedded aperture, if the embedded aperture is independently steered, it would cause that group of elements to no longer be in focus with the rest of the main aperture. The embedded aperture would not be as significant a portion of the main as the bifocal analogy, so it might be better to think of it as a small distortion near the edge of one's sunglasses. The light is already dimmed so the effect of the distortion is reduced. Since the contribution of the embedded subaperture to the main is attenuated, the independent steering has only a small impact of the main channel sidelobes.

For the elements in the subaperture(s), the beam steering computer may be programmed to control those elements differently from the main aperture elements. Any T/R element level dynamic tapering attenuation that would be applied to those elements may already be accounted for in the feed design. Consequently, tapers loaded into the BSC may have attenuation for subaperture elements zeroed out. The only attenuation applied to subaperture elements may be from calibration. T/R elements are generally not designed to retain their own calibration data (settings that align them in phase and gain with their neighbors.) These calibration offsets get sent to each T/R element as part of the beam steering command from the beam steering computer. In effect, in one exemplary embodiment, the beam steering computer uses the desired beam position as input to the phase slope equations to calculate the ideal phase and gain settings for each T/R element, "adds" any desired taper settings, then "adds" the calibration to the ideal settings to obtain the actual commands that will make the T/R elements achieve the true phase and gain needed to properly point the beam. In the exemplary embodiments illustrated in FIG. 1 and FIG. 3, since the taper attenuation is set with the coupler, the beam steering computer may be programmed to skip the "adds desired taper settings" step described above for only the embedded aperture elements. Another way to accomplish this is to manually zero out the taper attenuation settings for the embedded aperture elements. The net result is the same; the embedded aperture elements do not get taper attenuation as part of the beam steering command. They only get beam steering settings offset with calibration data.

Although the foregoing has been a description and illustration of specific embodiments of the subject matter, various modifications and changes thereto can be made by persons skilled in the art without departing from the scope and spirit of the invention as defined by the following claims.

What is claimed is:

1. An array antenna comprising:

an array of radiator elements, said array including a subaperture comprising one or more of said radiator elements;

a main receive channel;

a feed network coupling at least some of the radiator elements of the array of radiator elements to the main receive channel;

a special use receive channel;

an RF power dividing network connected in a signal path between said subaperture and the special use receive channel, the RF power dividing network adapted to pass a first portion of RF energy from said subaperture to the special use receiver channel while diverting a second portion of the RF energy from said subaperture to the main receive channel;

circuitry for introducing an amplitude taper to signals received from the array of radiator elements, so that at least some of said signals from said radiator elements are attenuated to achieve said amplitude taper, said circuitry including said RF power dividing network, wherein the second portion of the RF energy diverted to the main receive channel from the subaperture is substantially equal to an attenuated signal level for said subaperture to achieve an amplitude taper attenuation for said one of said radiator elements to match said amplitude taper, and wherein the first portion is greater than the second portion.

2. The array of claim 1, wherein said subaperture is located at an edge of said array of radiator elements.

3. The array of claim 1, wherein said circuitry comprises an attenuator coupled to respective ones of said array of radiator elements which do not include said subaperture.

4. The array of claim 1, wherein each of said radiator elements includes a radiator, a variable phase shifter and an attenuator, and wherein said circuitry includes said attenuator for said radiators excluding said subaperture.

5. The array of claim 4, further comprising a beam steering controller coupled to each of said radiator elements to set said phase shifters to settings adapted to steer a beam of said array to a desired direction.

6. The array of claim 1, wherein said RF power dividing network is a directional RF coupler.

7. The array of claim 1, wherein said subaperture consists of a single radiator element.

8. The array of claim 1, wherein said subaperture includes a plurality of radiator elements.

9. The array of claim 1, wherein the special use receive channel comprises a guard channel.

10. An array antenna, comprising:

an array of radiator elements;

a main receive channel;

a feed network coupling at least some of the radiator elements of the array of radiator elements to the main receive channel;

a special use receive channel;

an RF power dividing network connected in a signal path between one of said radiator elements and the special use receive channel, the RF power dividing network adapted to pass a first portion of RF energy to the special use receiver channel while diverting a second portion of the RF energy to the main receive channel;

circuitry for introducing an amplitude taper to signals received from the array of radiator elements, so that at least some of said signals from said radiator elements are attenuated to achieve said amplitude taper, said circuitry including said RF power dividing network, wherein the second portion of the RF energy diverted to the main receive channel is substantially equal to an attenuated signal level for said one of said radiator elements to achieve an amplitude taper attenuation for said one of said radiator elements, and wherein the first portion is greater than the second portion.

11. The array of claim 10, wherein said one of said radiator elements is located at an edge of said array of radiator elements.

12. The array of claim 10, wherein said circuitry comprises an attenuator included in respective ones of said array of radiator elements which do not include said one of said radiator elements.

13. The array of claim 10, wherein each of said radiator elements includes a radiator, a variable phase shifter and an attenuator, and wherein said circuitry includes said attenuator for said radiators excluding said one of said radiators.

14. The array of claim 13, further comprising a beam steering controller coupled to each of said radiator elements to set said phase shifters to settings adapted to steer a beam of said array to a desired direction.

15. The array of claim 10, wherein said RF power dividing network is a directional RF coupler.

16. The array of claim 10, wherein the special use receive channel comprises a guard channel.

17. An active array, comprising:

an array of radiator elements;

a main receive channel;

a feed network coupling at least some of the radiator elements of the array of radiator elements to the main receive channel;

a special use receive channel;

an RF directional coupler connected in a signal path between one of said radiator elements and the special use receive channel, the RF coupler adapted to pass a first portion of RF energy to the special use receive channel while diverting a second portion of the RF energy to the main receive channel; and means for introducing an amplitude taper to signals received from the array of radiator elements, so that at least some of said signals from said radiator elements are attenuated to achieve said amplitude taper, said attenuation means including said RF directional coupler, wherein the second portion of the RF energy diverted to the main receive channel is substantially equal to an attenuated signal level for said one of said radiator elements to achieve an amplitude taper attenuation for said one of said radiator elements, wherein the first portion is greater than the second portion; and wherein said one of said radiator elements is located at an edge of said array of radiator elements.

18. The active array of claim 17, wherein said means for introducing said amplitude taper comprises an attenuator included in respective ones of said array of radiator elements.

19. The active array of claim 17, wherein each of said radiator elements includes a radiator, a variable phase shifter and an attenuator, and wherein said means for introducing said amplitude taper includes said attenuator.

20. The active array of claim 19, further comprising a beam steering controller coupled to each of said radiator elements to set said phase shifters to settings adapted to steer a beam of said array to a desired direction.

21. The array of claim 17, wherein the special use receive channel comprises a guard channel.

* * * * *